US008199028B2

(12) United States Patent
Mudalige

(10) Patent No.: US 8,199,028 B2
(45) Date of Patent: Jun. 12, 2012

(54) PROTOCOL FOR MAP DATA TRANSMISSION FOR INFRASTRUCTURE TO VEHICLE COMMUNICATIONS

(75) Inventor: Upali Priyantha Mudalige, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 532 days.

(21) Appl. No.: 12/503,887

(22) Filed: Jul. 16, 2009

(65) Prior Publication Data

US 2011/0012755 A1 Jan. 20, 2011

(51) Int. Cl.
*G08G 1/09* (2006.01)

(52) U.S. Cl. ..... 340/905; 701/409

(58) Field of Classification Search ..... 340/905, 340/916, 917; 701/1, 400, 409
See application file for complete search history.

(56) References Cited

U.S. PATENT DOCUMENTS

| | | | | |
|---|---|---|---|---|
| 6,606,033 | B1 * | 8/2003 | Crocker et al. | 340/901 |
| 7,167,104 | B2 * | 1/2007 | DiPiazza | 340/905 |
| 2007/0276600 | A1 * | 11/2007 | King et al. | 701/301 |

* cited by examiner

*Primary Examiner* — Toan N Pham

(57) ABSTRACT

A method is provided for selectively transmitting stop sign intersection data to a vehicle in an infrastructure-to-vehicle communication system. The infrastructure-to-vehicle system includes a fixed entity for broadcasting wireless messages to vehicles in a predetermined area. The local intersection data is broadcast from a local intersection device at a first repetition rate. The local intersection data relates to the intersection in which the vehicle is currently approaching. Remote intersection data, such as map GID, is broadcast from the local intersection device at a second repetition rate. The remote intersection data relates to intersections beyond the vehicle's current approaching intersection. The second repetition rate is lower than the first repetition rate.

19 Claims, 3 Drawing Sheets

PROTOCOL FOR MAP DATA TRANSMISSION FOR INFRASTRUCTURE TO VEHICLE COMMUNICATIONS

BACKGROUND OF INVENTION

An embodiment relates generally to infrastructure-to-vehicle communications.

Active safety and driver assistance features typically use a combination of multiple driver alert warning modalities to provide optimum and effective alerts to the driver of a vehicle in a timely manner. The timing of such alert modalities plays an important role in determining the effectiveness and user acceptance of these features. Vehicle communications such as infrastructure-to-vehicle (I2V) is a technology that employs the transfer of information to vehicles from fixed transmitters that are part of a roadside infrastructure. Typically, large amounts of data are transferred between the infrastructure and the vehicle. It is essential that imminent safety-related information that has an effect on the vehicle be received by the vehicle from the infrastructure in a timely manner in order for the vehicle to process the information within the wireless message and issue an alert warning if necessary; however, receiving a wireless message where those pertinent portions of the wireless message used for processing imminent safety-related concerns is saturated with other data of the wireless message may result in the tardiness of issuing an alert.

SUMMARY OF INVENTION

An advantage of an embodiment of the invention is the prioritization of local intersection data broadcast from an infrastructure to a vehicle for ensuring that a vehicle approaching an intersection will receive and process the local intersection data prior before the vehicle enters a region where the safety-related information is required. The infrastructure broadcasts the local intersection data at a higher repetition rate than remote intersection data broadcast by the infrastructure so that the local intersection data may be processed and safety-related concerns may be evaluated before reaching the a location at the intersection where alerts may be required. It is also an advantage of the invention reduce the number broadcasting devices within the I2V system by eliminating a need for a broadcasting device at each intersection. Remote intersection data relating the intersections beyond the area of the current intersection is broadcast at a lower repetition rate in relation to the local intersection data and is received while the vehicle is within a maximum broadcasting range of the transmitting device.

An embodiment contemplates a method for selectively transmitting stop sign intersection data to a vehicle in an infrastructure-to-vehicle communication system. The infrastructure-to-vehicle system includes a fixed entity for broadcasting wireless messages to vehicles in a predetermined area. The local intersection data is broadcast from the remote entity at a first repetition rate. The local intersection data relates to at least one intersection in the predetermined area. Remote intersection data is broadcast from the remote entity at a second repetition rate. The remote intersection data relates to intersections beyond the predetermined area. The second repetition rate is lower than the first repetition rate.

An embodiment contemplates an infrastructure-to-vehicle system for broadcasting wireless messages to vehicles traveling in a predetermined area. The infrastructure-to-vehicle system including a fixed road side entity for broadcasting wireless messages to vehicles in the predetermined area. The fixed road side entity broadcasting system includes a processor for selectively controlling a broadcast of wireless messages in the predetermined area. The processor segregates local intersection data and remote intersection data. The local intersection data relates to at least one intersection in a predetermined area. The remote intersection data relates to intersections beyond the predetermined area. A transmitter broadcasts the local intersection data at a first repetition rate and the remote intersection data at a second repetition rate where the second repetition rate is lower than the first repetition rate.

DETAILED DESCRIPTION

Figure 1:
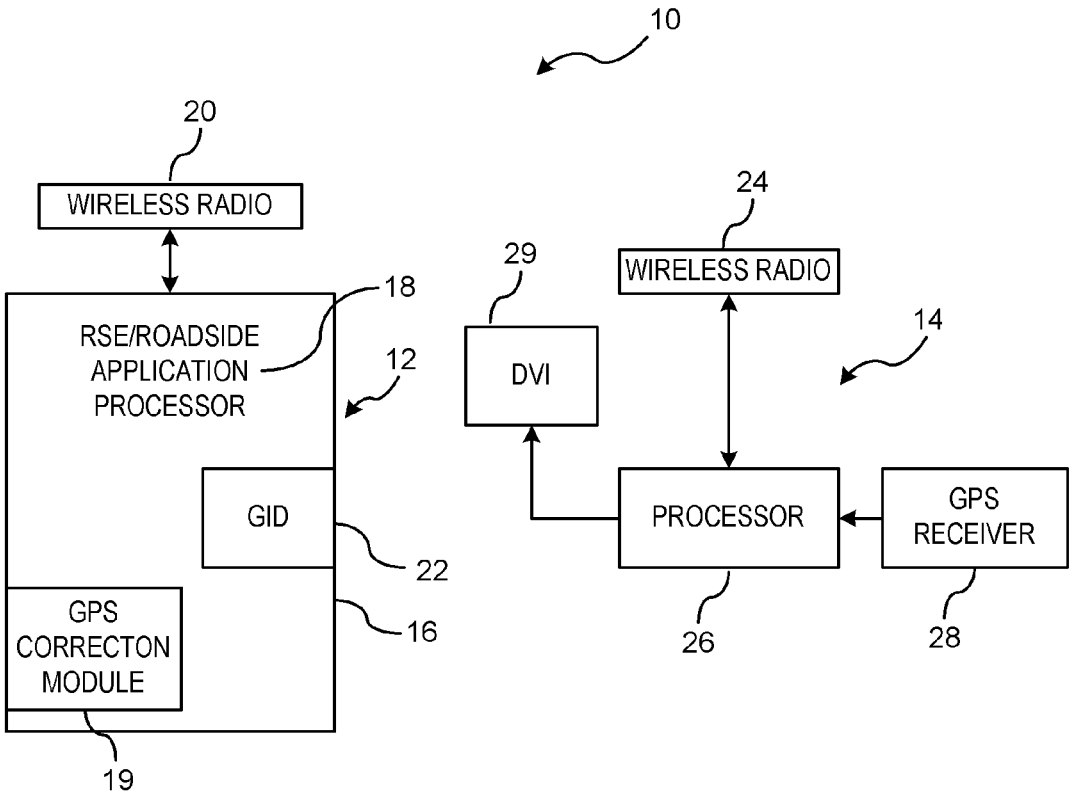
FIG. 1 is a block diagram of an infrastructure-to-vehicle communication system.

FIG. 1 is a block diagram of an infrastructure-to-vehicle (I2V) system 10. The I2V system communicates between an infrastructure 12 and a vehicle 14 while the vehicle is traveling with within a broadcast range of the infrastructure 12.

The infrastructure 12 includes a fixed entity such as road side equipment (RSE) 16 that broadcasts information to the vehicle 14. The information broadcast may be provided to the RSE 16 by a remote server. The information broadcast by the RSE 16 includes map data of intersections where the right of way of the intersection is regulated by stop signs. Alternatively, the system may be used with other stop signal markings/indicators including, but not limited to, a railroad crossing marking and a pedestrian crossing marking.

The RSE 16 includes a RSE processor 18 for processing data and controlling the broadcast of the data. Such data includes, but is not limited to, map data of the approaching intersection, the designated stopping location of the approaching intersection, and the speed limit data of the traveled road. Additionally, the data broadcast in the wireless message includes remote intersection data relating to intersection data beyond the current intersection.

The infrastructure 12 further includes a transmitter such as wireless communication radio 20 that includes, but not limited to, a dedicated short range communication (DSRC) radio, WiFi, or WiMaX. The wireless communication radio 20 is coupled to the RSE processor 16 for broadcasting a wireless data message to the vehicle 12 containing the information regarding the intersection. It should be understood that the information may be transmitted repetitiously in consecutive data packet transmissions for obtaining a predetermined packet reception probability. The intersection data is obtained from a geometric intersection data (GID) storage device 22. The intersection data may include, but is not limited to, map data of the intersection, intersection lane geometry, road grade, stopping location as well as distance between vehicles approaching the intersection. For intersections that require higher positional accuracy (e.g., vehicle lane-level positioning), the RSE processor 16 may further include a GPS augmentation module 19 for providing augmentation information (such as local GPS corrections) which provides further details in the wireless data messages at the intersection. The RSE processor 16 may also include local weather information in the wireless data messages at the intersection.

The vehicle 14 includes a receiver, such as an in-vehicle wireless radio 24, for communicating with the RSE 16. The vehicle 14 further includes a processor 26 for processing the received wireless messages broadcast by the RSE 16. The processor 26 is also coupled to a GPS receiver 28 for receiving GPS data relating to the global positioning of the vehicle 14. The processor 26 is in communication with other devices that either sense or assist in determining environmental conditions affecting the stopping of the vehicle 14. The processor 26 may also be in communication with one or more vehicle subsystems, such as a brake control module, for determining the velocity or acceleration of the vehicle. The processor 26 processes the data in wireless messages specifically the local intersection data of the intersection, the GPS data, and the vehicle speed/acceleration and determines whether a potential stop sign violation may occur. A driver warning alert is actuated for alerting the driver via a driver vehicle interface 29 in response to the determination that a potential stop sign violation may occur. The driver warning alert for alerting the driver of the upcoming stopping location may include, but is not limited to, an audible, visual, haptic signal or other vehicle control actions (e.g., automatic braking to avoid an imminent intersection collision).

It should be understood that the vehicle system for determining when to issue the alert warning may be a stand alone module or may be integrated with an existing controller, such as an automated cruise control controller or a headway configuration control controller.

Figure 2:
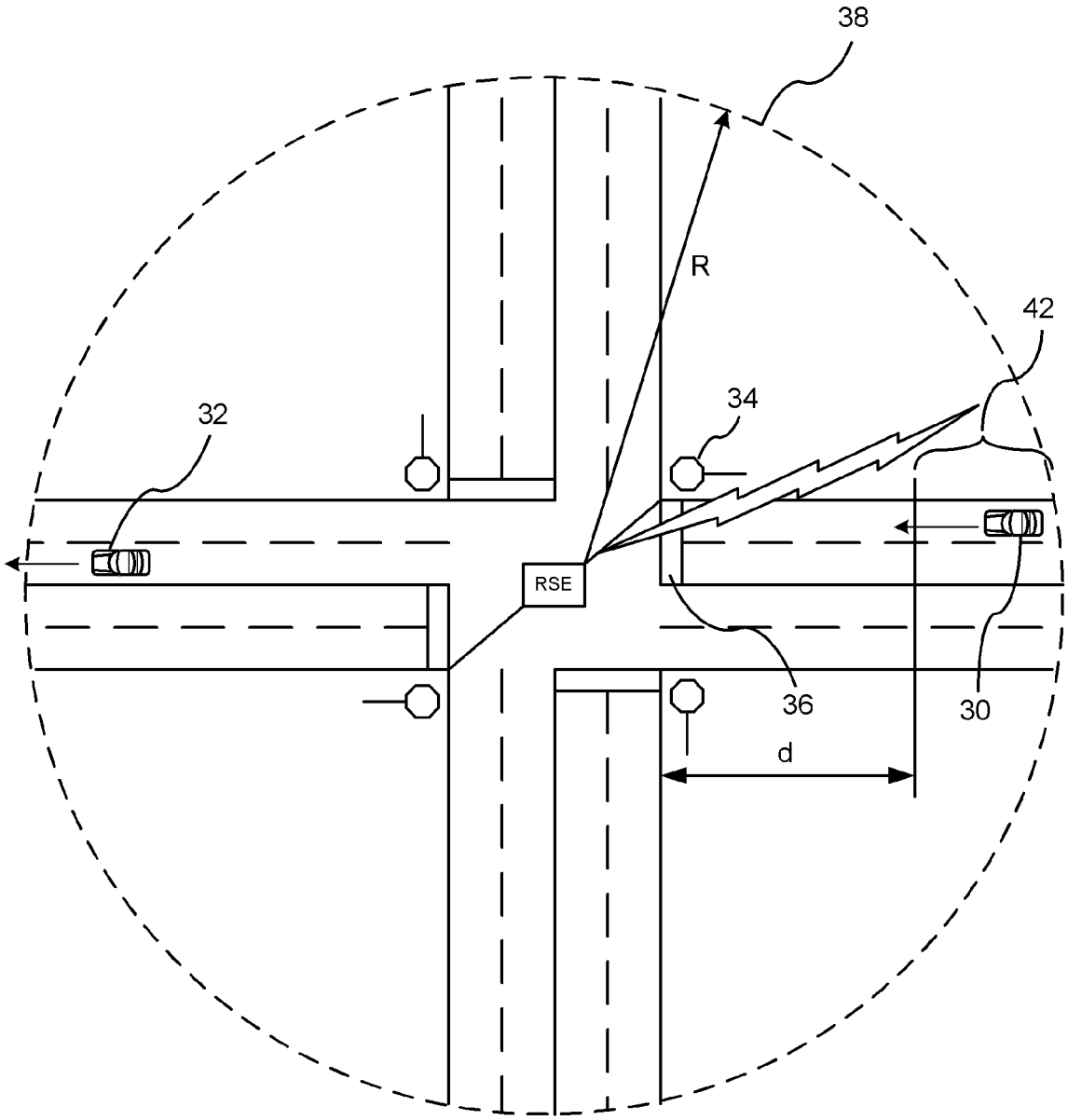
FIG. 2 is a plan view of a stop sign intersection.

FIG. 2 is a plan view of a respective intersection. Vehicle 30 is shown approaching an intersection in a predetermined area whereas a vehicle 32 is shown traveling away from the intersection. A plurality of stop signs 34 and/or stop locations 36 are disposed at each corner of the intersection for signaling to the driver of the respective vehicles that the vehicle must come to a complete stop before proceeding through the intersection for stop sign controlled intersection. Respective markings in the road 36 identify the designated stopping location where the driver of the vehicle brings the vehicle to a rest position before proceeding through the intersection.

The RSE 16 is fixedly disposed at or near the intersection for effectively communicating with respective vehicles within the predetermined area either approaching or exiting the intersection. The RSE 16 may be located to the side of the road or may be suspended over the intersection. The RSE 16 has a maximum broadcast range (R) as generally indicated by 38.

The RSE processor 18 segregates the local intersection data of the intersection within the predetermined area from the remote intersection data of intersections beyond the predetermined area. The local intersection data and the remote intersection data are respectively broadcast in separate wireless messages. It is of greater priority for vehicle 30 to acquire the local intersection data than it is to acquire remote intersection data when vehicle 30 is approaching the intersection within the predetermined area so that vehicle 30 may process the local intersection data for determining if a stop sign violation warning should be actuated. It should be understood that the term stop violation warning is not limited to violation of a stop sign indicator but includes other types of signal violation warning features for a respective intersection such as red light violations, pedestrian crossing and rail road violation. Broadcasting the local intersection data with the remote intersection data in a same data package may result in vehicle 30 not receiving the local intersection data in a timely manner which could result in a failure to actuate a stop sign warning in a timely manner required for the driver to react. Therefore, local intersection data is broadcast by the wireless radio 20 at a first repetition rate and remote intersection data relating to intersections beyond the predetermined area is broadcast by the wireless radio 20 at a second repetition rate. The first repetition rate in which the local intersection data is broadcast is a higher rate than the second repetition rate in which the remote intersection data is broadcast.

To effectively communicate the local intersection data to vehicle 30 in a timely manner so that it may be processed by the vehicle processor 26 for determining whether a stop sign warning should be issue, the vehicle 30 should receive the local intersection data prior to the vehicle reaching a critical distance 40 from the designated stopping location 36. Therefore, the repetition rate at which the local intersection data is broadcast must be performed at a rate which allows the vehicle to receive the wireless message while the vehicle 30 is in a first respective region 42 as shown in FIG. 2. Region 42 is defined as a respective region between the distance designated by the maximum broadcast range R 38 of the wireless radio 20 and the location of the critical distance 40 from the designated stopping location 36. Moreover, the data packet containing the local intersection data within the wireless message may be repetitiously transmitted a predetermined number of times for a desired probability of successfully receiving the data packet by the receiver of vehicle 30. That is, successful transmission of a data packet increases with an increase in the number of consecutive transmissions of the data packet. Therefore, a desired probability for successfully receiving the data packet may be determined as a function of the number of consecutive wireless message transmissions of the same data pack which will be discussed in detail later.

As discussed earlier, the local intersection data and other data such as signal phase and timing, GPS corrections are transmitted at a repetition rate based on the message being received before the vehicle reaches a critical distance from the stopping location at the intersection because such information is necessary for executing applications belonging to the local intersection. The formula for determining the repetition rate for broadcasting the wireless message containing the local intersection and other data is as follows:

$$f_L = \left(\frac{N(V)}{R-d}\right) \tag{1}$$

where $f_L$ is the repetition rate for broadcasting the local intersection data, N is the number of consecutive packet transmissions needed by the RSE to obtain a desired packet reception probability, V is the speed limit, R is the transmission range, and d is the critical distance between the vehicle and the stopping location at the intersection.

The remote intersection data is broadcast as a separate message from the local intersection data and is broadcast at a repetition rate that is lower than the repetition rate of the local intersection data. The remote intersection data relates to intersections beyond the predetermined area, and therefore, is not utilized by the stop sign warning routine for the local intersection in the predetermined area. Since there is no immediate need for the remote intersection data to be received by the vehicle as it approaches the local intersection, the priority for receiving the remote intersection data is secondary in comparison to the local intersection data. As a result, the remote intersection data may be broadcast at any time while the vehicle is within the maximum broadcasting range of the RSE 16, including when the vehicle traveling through or away from the intersection. The repetition rate for broadcasting the remote intersection data for intersections beyond the predetermined area is as follows:

$$f_r = \frac{N(V)}{2(R)} \quad (2)$$

where $f_r$ is the repetition rate for broadcasting the remote intersection data, N is the number of consecutive packet transmissions needed by the road side equipment to obtain a respective packet reception probability, V is the speed limit, and R is the transmission range. Remote data is not limited to intersection data, it can be any other information as required by the set of vehicle and infrastructure applications running.

As discussed earlier, the wireless radio may broadcast the local intersection data and the remote intersection data a consecutive number of times at their respective repetition rates for obtaining a desired probability of success for the vehicle to receive the respective data messages. Increasing the number of consecutive transmissions increases the likelihood that the respective intersection data will successfully be received while the vehicle is within each respective broadcast region. The formula for estimating a data packet reception probability is as follows:

$$P = 1 - \mathrm{PER}^N \quad (3)$$

where P is a resulting probability of receiving the data packet based on the number of consecutive packet transmissions, PER is the packet error rate, and N is the number of consecutive packet transmissions needed by the road side equipment to obtain a respective packet reception probability.

An example for determining a probability estimate is as follows. If a packet error rate PER is 30% at 300 m range, then a number of consecutive packet transmissions of 3 would result in a probability of reception of 97.3%. In yet another example, utilizing a packet error rate PER of 30% at 300 m range and a number of consecutive packet transmissions of 4 would result in a probability reception of 99.2%.

Figure 3:
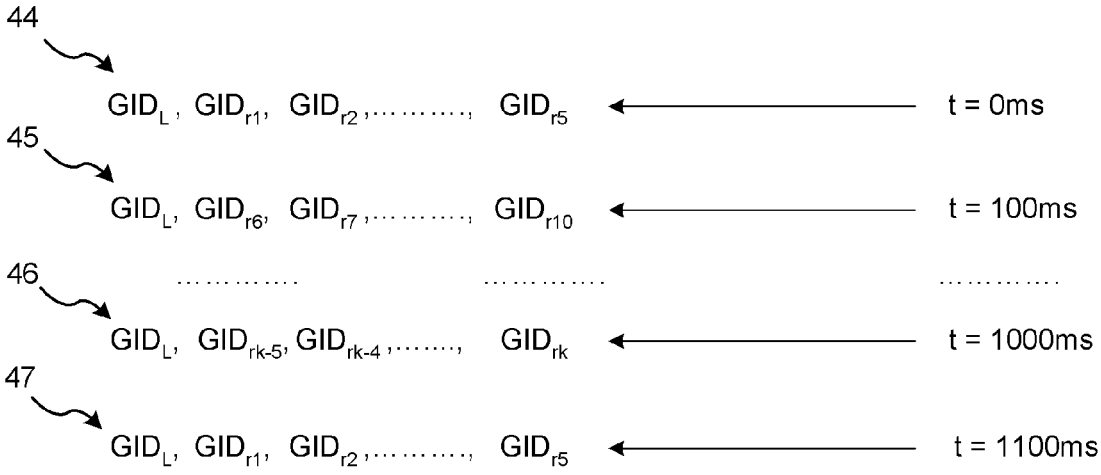
FIG. 3 is an example of map data transmission scheme.

FIG. 3 illustrates an example of grouping the respective messages broadcast at the first repetition rate and the second repetition rate. In the example provided in FIG. 3, the RSE broadcasts the local intersection data GID and the remote intersection data GIDs in groups. Each group is transmitted at a respective transmission cycle. Each group contains the local intersection data GID ($GID_L$) and a number of remote intersection data GIDs represented by $GID_r$*. At the beginning of each transmission cycle, the local intersection data ($GID_L$) is broadcast first at its respective repetition rate. Thereafter, a number of remote intersection data GIDs are broadcast at their respective repetition rates. The local intersection data $GID_L$ and each remote intersection data GID are broadcast as separate messages.

In the example of FIG. 3, it should be understood that the transmission cycle times, the frequencies, and number of GIDs in each group are exemplary only and that these respective values may be different based on the desired transmission cycle time and intersection data. In FIG. 3, the RSE broadcasts the local and remote GIDs in groups at each transmission cycle. The local GID is broadcast at a higher message transmission priority than the remote GIDs. The RSE transmission cycle time for each group is set to 100 ms and the respective GIDs are broadcast at their optimum repetition rates determined by the formulas in eq. (1) and eq. (2). In this example, the local intersection data is broadcast at $f_L$=10 Hz as determined by eq. (1) and the remote intersection data is broadcast at $f_r$=1 Hz as determined by eq. (2).

Group I, designated generally by 44, is broadcast at transmission cycle time t=0 ms. The local intersection data $GID_L$ is the first GID broadcast in Group I. $GID_L$ is broadcast at 10 Hz. Following the broadcast of $GID_L$, a respective number of remote intersection data GIDs (e.g., $GID_{r1}$ through $GID_{r5}$) are broadcast at 1 Hz until the first transmission cycle time duration (e.g. 0-99 ms) is completed. $GID_{r1}$ through $GID_{r5}$ each represent intersection data for different intersections within a respective region from the local intersection.

At transmission cycle time t=100 ms, the GIDs represented in Group II, designated generally by 45, are broadcast at their respective repetition rates. In Group II, the local intersection data $GID_L$ is the first GID broadcast. The local intersection data $GID_L$ is broadcast at 10 Hz. Following the broadcast of $GID_L$, a respective number of remote intersection data GIDs (e.g., $GID_{r6}$ through $GID_{r10}$) are broadcast at 1 Hz until the first transmission cycle time duration (e.g. 100-199 ms) is completed. $GID_{r6}$ through $GID_{r10}$ each represent intersection data for different intersections within a respective region from the local intersection. The transmission cycles are continuously broadcast at 100 ms intervals as illustrated in FIG. 3 until all of the remote intersection data GIDs (e.g. $GID_{rk}$) are broadcast as illustrated by the group 46. After each remote data map is transmitted once, each respective group is re-broadcast in the same order as previously described. That is, starting with Group I, the transmission scheme for each of the GIDs is rebroadcast starting at transmission cycle t=1100, generally shown at 47. Each of the remaining respective groups is re-broadcast at the 100 ms transmission cycle time intervals. The broadcast scheme is repeated continuously. Each remote intersection data GID is broadcast N number of times as needed to achieve the require packet reception probability. As a result, an approaching vehicle receives local intersection data quicker than remote intersection GID data at the desired probability determined by N.

Figure 4:
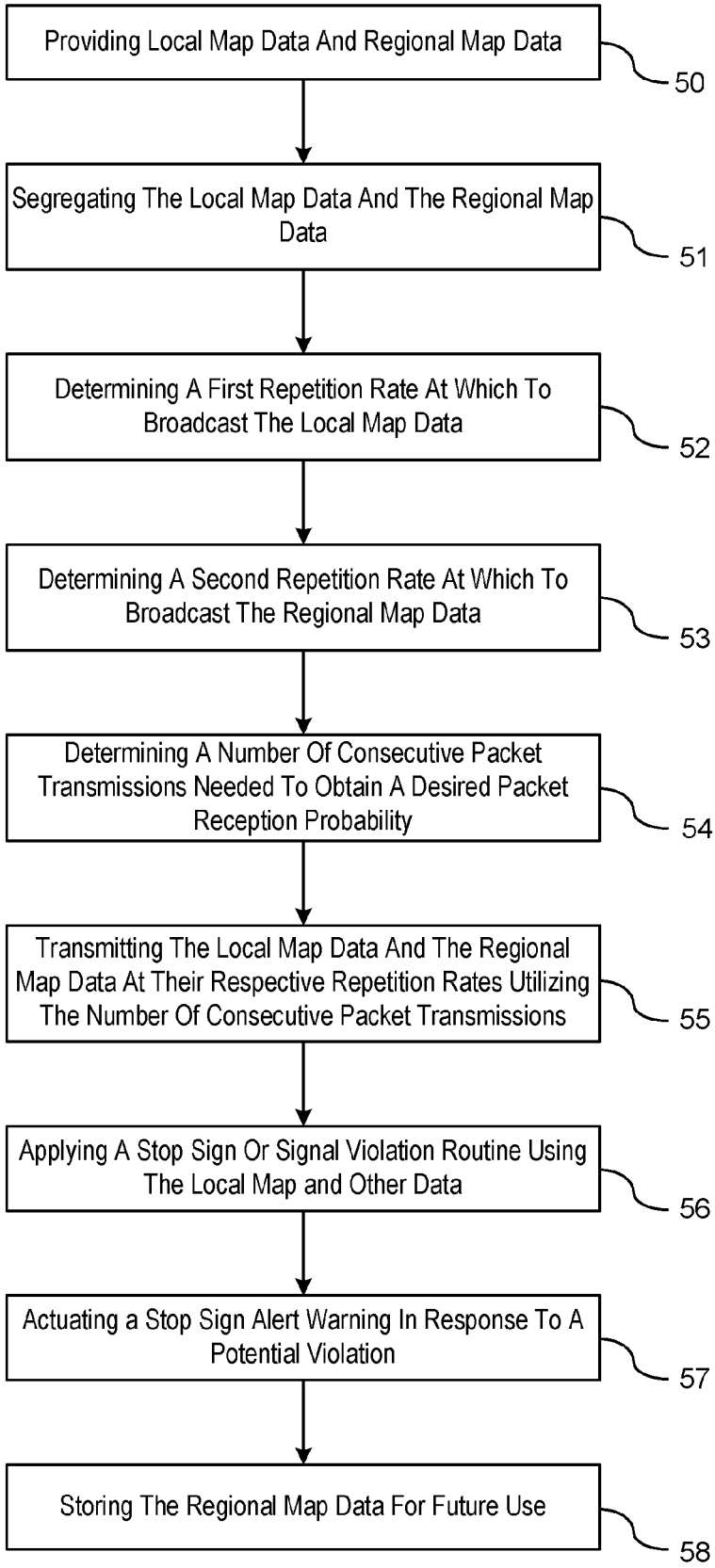
FIG. 4 is a flow diagram of a method of broadcasting intersection map data within the I2V system.

FIG. 4 illustrates a flowchart of a method for applying the I2V communication of intersection data. In step 50, local intersection data and remote intersection data are provided to the RSE. The local and remote intersection data may be stored in a memory at the RSE or the respective data may be downloaded from a remote server in communication with the RSE.

In step 51, the local intersection data and the region intersection data are segregated for broadcasting the two sets of data in different data transmission packets.

In step 52, the first repetition rate for broadcasting the local intersection data is determined. The first repetition rate is calculated using the formula shown in eq. (1). The first repetition rate is based on transmitting the information when the vehicle is in a respective region defined by the maximum broadcasting range of the RSE and the location that is a critical distance from the stopping location.

In step 53, the second repetition rate for broadcasting the remote intersection data is determined. The second repetition rate is calculated using the formula shown in eq. (2). The second repetition rate is based on transmitting the information when the vehicle is anywhere within the maximum broadcasting range of the RSE. Since the remote intersection data is not required for the current traveled intersection, the remote intersection data may be received by the vehicle when the vehicle is traveling through or away from the intersection.

In step 54, the number of consecutive packet transmissions is determined. A respective packet reliability probability is determined as a function of the number of consecutive packet transmissions using the formula shown in eq. (3).

In step 55, the local intersection data and remote intersection data are broadcast at their respective repetition rates utilizing the number of consecutive packet transmissions for obtaining the desired packet reliability probability.

In step 56, the local data is processed by a stop sign assistance routine for determining whether the vehicle may violate a stopping condition at the intersection. The local intersection data may be provided to other vehicle safety related routines, vehicle controllers, or processors for performing a vehicle-related function or vehicle safety related function.

In step 57, a stop sign or signal violation alert warning is actuated in response to a potential violation as determined by the stop sign or signal violation assistance routine.

In step 58, the remote intersection data is stored in a memory storage device within the vehicle for later retrieval. The stored remote intersection data may be recalled from memory when a respective intersection for which map data has been stored is approached by the vehicle. The recalled remote intersection data may be utilized the similar manner discussed above for the local intersection. As the vehicle approaches a respective remote intersection, a determination is made whether the vehicle is in violation of stopping the vehicle at the respective intersection.

It should be understood that by broadcasting the remote intersection data and storing the remote intersection data for later retrieval, a respective RSE is not required to be set up at each intersection. An advantage of an embodiment as described herein eliminates the need for a RSE at each stop sign location. Strategically, those intersections which are more heavily traveled would have a RSE for transmitting both local and remote intersection data. As a result, a RSE disposed at a respective intersection with heavy traffic flow would provide intersection data not only for the intersection which is it located, but for neighboring intersections within a certain proximity to the local intersection. This would enhance dissemination of remote intersection data to a greater number of vehicles in comparison to a lesser traveled intersection while reducing the need for a RSE at every intersection. Reducing a RSE at each intersection ultimately reduces the cost and the amount of equipment.

While certain embodiments of the present invention have been described in detail, those familiar with the art to which this invention relates will recognize various alternative designs and embodiments for practicing the invention as defined by the following claims.

What is claimed is:

1. A method for selectively transmitting stop sign intersection data to a vehicle in an infrastructure-to-vehicle communication system, the infrastructure-to-vehicle communication system including a fixed entity for broadcasting wireless messages to vehicles in a predetermined area, the method comprising the steps of:

broadcasting local intersection data from a remote entity at a first repetition rate, the local intersection data relating to at least one intersection in the predetermined area; and broadcasting remote intersection data from the remote entity at a second repetition rate, the remote intersection data relating to intersections beyond the predetermined area, the second repetition rate being lower than the first repetition rate.

2. The method of claim 1 wherein the first repetition rate is determined as a function of successfully broadcasting local intersection data to vehicles while the vehicles are within a first broadcast region and traveling within a set speed limit, the first broadcast region being a respective region between a maximum broadcasting range of the first entity and a critical distance from a designated stopping location of the intersection.

3. The method of claim 2 wherein the first repetition rate for transmitting the local intersection data is determined by formula:

$$f_L = \left(\frac{N(V)}{R-d}\right)$$

where $f_L$ is the first repetition rate, N is a number of consecutive packet transmissions needed by a road side equipment to obtain a respective packet reception probability, V is the speed limit, R is the broadcasting range, and d is the critical distance between a vehicle and the stopping location at the intersection.

4. The method of claim 3 wherein the second repetition rate is determined as a function of broadcasting remote intersection data within a second broadcast region that successfully provides the remote intersection data to vehicles while traveling within the second broadcast region, the second broadcast region relating to an entire broadcast region within the maximum broadcasting range of the fixed entity.

5. The method of claim 4 wherein the second repetition rate for transmitting the remote intersection data is determined by formula:

$$f_r = \frac{N(V)}{2(R)}$$

where $f_r$ is the second repetition rate, N is the number of consecutive packet transmissions needed by the road side equipment to obtain a respective packet reception probability, V is the speed limit, and R is the broadcasting range.

6. The method of claim 5 wherein the packet reception probability is determined by formula:

$$P = 1 - \mathrm{PER}^N$$

where P is a resulting probability of receiving the data packet based on the number of consecutive packet transmissions, PER is the packet error rate, and N is the number of consecutive packet transmissions needed by the road side equipment to obtain a respective packet reception probability.

7. The method of claim 1 wherein the local and remote intersection data broadcast by the remote entity includes geometric intersection data maplets.

8. The method of claim 1 further comprising the steps of:

receiving the local intersection data;

applying a stop sign assistance routine for analyzing a vehicle speed in relation to a designated stopping location at the intersection as the vehicle approaches the intersection; and actuating an alert in response to the stop sign assistance routine determining that the vehicle speed exceeds a threshold for stopping the vehicle the designated stopping location.

9. An infrastructure-to-vehicle system for broadcasting wireless messages to vehicles traveling in a predetermined area, the infrastructure-to-vehicle system including a fixed road side entity for broadcasting wireless messages to vehicles in the predetermined area, the fixed road side entity broadcasting system comprising:

a processor for selectively controlling a broadcast of wireless messages in the predetermined area, the processor segregating local intersection data and remote intersection data, the local intersection data relating to a local intersection in the predetermined area, the remote intersection data relating to intersections beyond the predetermined area; and a transmitter for broadcasting the local intersection data at a first repetition rate and the remote intersection data at a second repetition rate, wherein the second repetition rate is lower than the first repetition rate.

10. The system of claim 9 wherein the fixed road side entity is disposed at the local intersection.

11. The system of claim 9 wherein the processor selectively controls the transmitter for broadcasting the wireless messages, wherein local intersection data broadcast at the first repetition rate is determined as a function of successfully broadcasting local intersection data to the vehicles while the vehicles are within a first broadcast region and traveling within a set speed limit, and wherein the first broadcast region is located between a maximum broadcasting range of the transmitter and a location of a critical distance from a designated stopping location of the intersection.

12. The system of claim 11 wherein the first repetition rate for transmitting the local intersection data is determined by formula:

$$f_L = \frac{N(V)}{(R-d)}$$

where $f_L$ is the first repetition rate, N is a number of consecutive packet transmissions needed by the fixed road-side entity to obtain a respective packet reception probability, V is the speed limit, R is the broadcasting range, and d is the critical distance between the vehicle and the stopping location at the intersection.

13. The system of claim 12 wherein the second repetition rate is determined as a function of broadcasting remote intersection data within a second broadcast region that successfully provides the remote intersection data to vehicles while traveling within the second broadcast region.

14. The system of claim 13 wherein the second repetition rate for transmitting the remote intersection data is determined by formula:

$$f_r = \frac{N(V)}{2(R)}$$

where $f_r$ is the second repetition rate, N is the number of consecutive packet transmissions needed by the fixed road-side entity to obtain a respective packet reception probability, V is the speed limit, and R is the broadcasting range.

15. The system of claim 14 wherein the fixed road-side entity determines a probability of reception, the probability of reception relates to a probability of successfully receiving the wireless message within the respective regions, the probability is determined by formula:

$$P = 1 - \mathrm{PER}^N$$

where P is a resulting probability of receiving the wireless message based on the number of consecutive packet transmissions, PER is a packet error rate, and N is a number of consecutive packet transmissions needed by the fixed road-side entity to obtain a respective packet reception probability.

16. The system of claim 14 wherein the local and remote intersection data broadcast by a remote entity includes geometric intersection data maplets.

17. The system of claim 9 further comprising a receiver within a vehicle for receiving the local intersection data, the receiver providing the intersection data to a vehicle processing unit for applying a stop sign assistance routine for analyzing a vehicle speed in relation to a designated stopping location at the intersection as the vehicle approaches the intersection wherein an alert signal is actuated in response to the stop sign assistance routine determining that the vehicle speed exceeds a threshold for stopping the vehicle a designated stopping location.

18. The system of claim 17 further comprising a memory device for storing the remote intersection data, wherein the remote intersection data is retrieved by the processor as the vehicle approaches a respective intersection having an associated maplet stored in the memory device.

19. The system of claim 17 wherein the receiver is integrated as part of a wireless radio for communicating with the fixed road-side entity.

* * * * *